US012121089B2

(12) United States Patent
Jorgensen

(10) Patent No.: US 12,121,089 B2
(45) Date of Patent: Oct. 22, 2024

(54) WEARABLE ARTICLES WITH EMBEDDED FIDGET ELEMENTS AND SENSORY AIDS

(71) Applicant: Emily I Jorgensen, Dorr, MI (US)

(72) Inventor: Emily I Jorgensen, Dorr, MI (US)

( * ) Notice: Subject to any disclaimer, the term of this patent is extended or adjusted under 35 U.S.C. 154(b) by 258 days.

(21) Appl. No.: 17/524,078

(22) Filed: Nov. 11, 2021

(65) Prior Publication Data

US 2022/0151310 A1 May 19, 2022

Related U.S. Application Data

(60) Provisional application No. 63/115,823, filed on Nov. 19, 2020.

(51) Int. Cl.

| | |
|---|---|
| ***A41D 27/20*** | (2006.01) |
| ***A41D 1/00*** | (2018.01) |
| ***A41D 27/24*** | (2006.01) |
| ***A63F 7/04*** | (2006.01) |

(52) U.S. Cl.

CPC ..... *A41D 27/20* (2013.01); *A41D 1/00* (2013.01); *A41D 27/24* (2013.01); *A63F 7/04* (2013.01); *A41D 2400/32* (2013.01)

(58) Field of Classification Search

CPC ..... A61M 21/02; A41B 13/005; A41B 13/04; A41D 1/00; A41D 1/02; A41D 1/04

See application file for complete search history.

(56) References Cited

U.S. PATENT DOCUMENTS

| | | | | |
|---|---|---|---|---|
| 1,085,897 | A * | 2/1914 | Feld | A41F 17/00 2/273 |
| 4,854,319 | A * | 8/1989 | Tobin | A61F 7/10 2/171.2 |
| 4,913,149 | A | 4/1990 | Rourick-Hamczyk | |
| 10,070,674 | B1 * | 9/2018 | Beckers | A41D 27/00 |
| 2009/0025124 | A1 * | 1/2009 | Gearhart | A41F 17/00 2/400 |
| 2009/0149698 | A1 | 6/2009 | Tastard | |
| 2013/0247277 | A1 * | 9/2013 | Turbovich | A63H 33/006 2/243.1 |
| 2015/0273178 | A1 * | 10/2015 | Johnson | A61M 21/02 600/27 |
| 2016/0232804 | A1 | 8/2016 | Nichols et al. | |
| 2016/0366953 | A1 * | 12/2016 | Watts | A41D 1/04 |
| 2018/0295912 | A1 * | 10/2018 | Watts | A41D 13/0058 |
| 2018/0326175 | A1 * | 11/2018 | Figures | A61F 5/3723 |
| 2019/0059815 | A1 * | 2/2019 | Smith | A41D 27/08 |
| 2019/0274397 | A1 | 9/2019 | Jakob | |

* cited by examiner

*Primary Examiner* — Megan E Lynch
*Assistant Examiner* — Giao Qt Hoang
(74) *Attorney, Agent, or Firm* — Gardner, Linn, Burkhart & Ondersma LLP

(57) ABSTRACT

A wearable article is provided that includes embedded fidget elements that may be manipulated by the wearer. The fidget elements can be discreetly incorporated into various locations on the wearable article such as at hemlines, pockets, and other areas accessible to the wearer of the article of clothing. Incorporating fidget elements into a wearable article reduces distractions caused by using fidget elements while also maintaining benefits such as comfort, focus, concentration, reduced stress and entertainment that fidget elements provide to the user. The type and locations of the fidget elements on a wearable article may be customized to the needs and desires of the wearer of the clothing article, as are the properties of the fidget elements themselves.

11 Claims, 5 Drawing Sheets

WEARABLE ARTICLES WITH EMBEDDED FIDGET ELEMENTS AND SENSORY AIDS

CROSS REFERENCE TO RELATED APPLICATION

The present application claims the benefit of U.S. provisional application Ser. No. 63/115,823, filed Nov. 19, 2020, which is hereby incorporated herein by reference in its entirety.

FIELD OF THE INVENTION

The present invention is directed to articles and methods used to address issues with attention focus, disorders and stress alleviation.

BACKGROUND OF THE INVENTION

The term "fidget" is often used to refer to devices and/or elements that are designed to provide a user with sensory feedback when handled or manipulated. Fidget devices, such as fidget spinners or fidget cubes, are typically a manipulable assembly that is more complex and recognizable than a single fidget element. Fidget elements, on the other hand, such as beads, pellets, or a piece of uniquely textured material, are simple articles that have been incorporated into strings, bracelet or other objects such as toys. Fidget devices and elements are often generally referred to as fidgets, even though the device or element represents an item which is a tool rather than the act of fidgeting itself. Each fidget is designed to provide a user with sensory feedback such as tactile feedback, audible feedback, or a combination thereof, typically when manipulated by hand.

The sensory feedback provided by a fidget may have beneficial effects on the user. Some of these benefits include providing comfort, entertainment, limiting or reducing stress, and increasing mental focus and concentration. The term "worry beads" has been applied to strings of beads that are handled as a form of stress reliever, often by persons who do not present particular medical conditions that require treatment or other needs for movement or tactile input. The benefits associated with fidgets are especially pronounced, however, when used by adults and children with special medical, physical or mental needs, such as Autism, Asperger's, or Attention-Deficit/Hyperactivity Disorder (ADHD) or those with sensory processing difficulties. For example, persons with ADHD or Autism disorders often have sensory integration problems which drive them to seek extra sensory stimulation by means of touching items, moving their bodies, or activities which may be disruptive to learning and otherwise may be contrary to social norms.

One problem associated with fidgets is their ability to cause a distraction while the fidget is being used. For example, the user of a fidget may be unaware that the fidget is making a noise while it is being used, thereby causing an audible distraction to others nearby. Likewise, even if no audible sound is being generated by using the fidget, playing with the fidget may nonetheless cause a visual distraction to others nearby. Moreover, playing with the fidget may distract the user themselves from something that requires their attention, such as listening to a lecture in class. Therefore, there are instances where the benefits of fidgets can be outweighed by the distractions they cause to the user or others nearby. Moreover, the negative perception often associated by the public with conditions such as Autism or ADHD may have negative impact on persons making use of a fidget, or even with having such a fidget recognizably available. This is particularly pronounced with children who become familiar with fidgets and their use by persons with special conditions or needs, such that the mere recognition of a fidget may have negative repercussions on the user. Even in instances in which others do not recognize a fidget or associate it with persons having an atypical condition or disorder, a child having a fidget may be stressed or otherwise have concerns about the attitudes of others toward people requiring their use.

SUMMARY OF THE INVENTION

The present invention is directed toward reducing the distractions caused by fidgets while still maintaining the benefits they offer the user. This is accomplished according to a preferred form of the invention in a system that provides fidget elements which are incorporated into a wearable article such as a shirt, sweatshirt, jacket, gloves, or pants. In preferred form, a fabric channel, sleeve or pouch is formed in or on a garment at a location that can be reached by hand by the person wearing the garment. One or more fidget elements are movably received and enclosed in the channel, and sized so as to be manipulably slid or rolled along the interior of the channel. The material forming the channel or sleeve is sufficiently flexible and resilient that a person wearing the garment may manually handle part of the channel and move one or more of the fidget elements along the interior of the channel. The thickness of the material making up the channel is sufficiently thin relative to the size of the fidget element that the person manipulating the channel is able to detect the location of the fidget element through the channel material and move the fidget element within.

In a preferred form the material forming the channel may be fabric of the garment itself. In such an embodiment a hem is formed along an edge or seam of the garment, with a channel or pocket formed within the folded hem or at the seam. Alternatively, the fabric may be a section of material that is applied to the garment in the form of a patch or layer, and may be made of the same material as that of the garment or alternatively a different type or thickness of material. Particularly in embodiments in which the garment is to be made of thick material, such as a coat, sweatshirt or thick pants, a thinner material may be incorporated as the patch to form the channel enclosure. The fidget element material is sufficiently rigid to allow manipulation through the fabric making up the channel, but may alternatively be sufficiently resilient or elastomeric that contact between adjacent fidget elements does not produce a distracting noise.

In forming the channel along which the fidget element or elements are intended to be moved, the pathway of the channel may be generally linear or alternatively formed as a convoluted or tortuous pathway. Non-linear pathways provided by the channel may in some instances be particularly effective in that a non-linear pathway may require greater concentration or manipulation to move the fidget element and the fidget element is less likely to move due to gravity or otherwise too easily along the channel. In embodiments in which a pouch is formed on the garment to enclose the fidget elements, the fidget element or elements may be manipulated in non-linear directions and groups of fidget elements moved collectively. In alternative embodiments the channel is sized sufficiently to allow the fidget element to freely move along the channel, but alternatively the channel is sized to tightly encompass the fidget element to provide for movement along the channel but with much greater effort or resistance to movement. As a still further alternative the fidget element is secured on or in the garment so as to not be moveable relative to the garment.

In the preferred embodiments visual distractions caused by fidget elements are reduced through discreetly incorporating the fidget elements into wearable articles at strategic locations. These include along hemlines of the articles, on interior surfaces of the articles, or in other locations on the articles that are not readily observable by peers. Visual distractions are also reduced as a result of limiting obvious and observable misuse of the fidget elements by a user. This is accomplished because the wearable article restrains the movement of the fidget elements which are embedded within the wearable articles. Audible distractions are similarly reduced as the wearable articles also act to dampen noise caused by the fidget elements.

These and other objects, advantages, and features of the invention will become apparent by review of the following specification in conjunction with the drawings.

DESCRIPTION OF THE PREFERRED EMBODIMENTS

Figure 1:
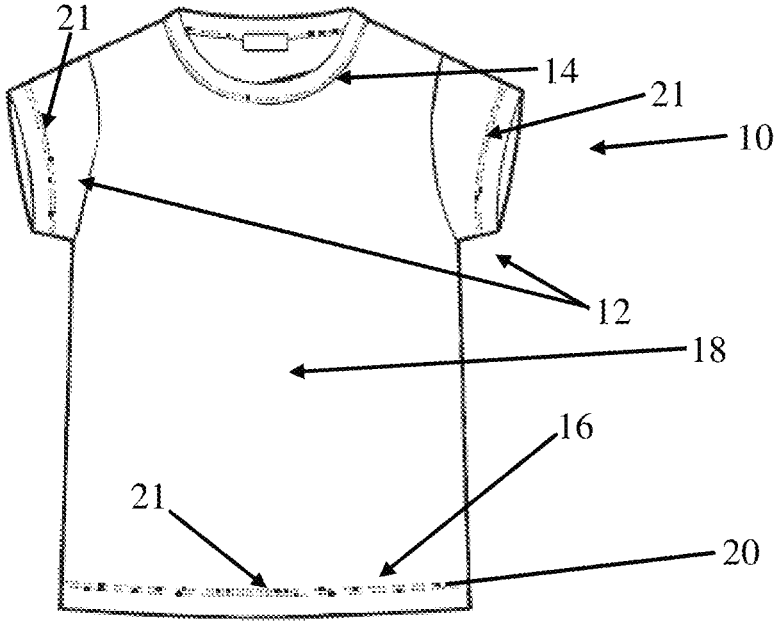
FIG. 1 is a frontal perspective view of an embodiment of the invention in which a t-shirt is embedded with fidget elements.

Referring now to the drawings and the illustrative embodiments depicted therein, a t-shirt 10 (FIG. 1) has an overall base configuration that is of conventional garment shape and having a conventional garment size for the wearer. T-shirt 10 includes a pair of sleeves 12, a collar 14, a waist hemline 16, and a middle torso region 18. Unlike conventional garments, t-shirt 10 includes a set of fidget elements 20 discreetly incorporated into attachment areas, such as waist hemline 16. Fidget elements 20 may vary widely, and generally include tactile elements that can be rubbed, squeezed, or otherwise touched (such as a piece of satin or other uniquely textured article) or manipulable elements that can be "fiddled" with or otherwise moved or manipulated such that they move or rotate independently of a wearable article of clothing (such as beads or pellets). Incorporation of fidget elements 20 into waist hemline 16 can be achieved through various methods such as sewing or adhering the fidget elements 20 into waist hemline 16, with waist hemline 16 acting as an elongated channel 21 or enclosure. Fidget elements 20 in the form of manipulable elements may be received and contained within channel 21. The outer dimensions of manipulable elements are sized to be smaller than channel 21 formed by hemline 16 so as to provide the wearer with the ability to push fidget elements 20 along hemline 16. The dimensions of channel 21 may also be sized to restrict movement of manipulable elements within channel 21 until a user manipulates channel 21 and/or the manipulable elements within channel 21.

Although FIG. 1 depicts fidget elements 20 as being incorporated into waist hemline 16, fidget elements 20 may alternatively or additionally be incorporated into other areas of t-shirt 10 as well. For example, fidget elements 20 may be incorporated into hemlines or channels 21 formed on sleeves 12, collar 14, or a location on middle torso region 18 of t-shirt 10 (FIG. 1). These locations are adapted to optionally incorporate fidget elements 20 at interior hemlines, or hemlines on the interior or body-side surface of the garment, such that the fidget elements would be visually imperceptible to an outside observer, or an observer of the wearer of t-shirt 10. It should be recognized that manipulable elements, such as beads, pellets, or other spherical or polyhedral-shaped objects may also be attached to a garment in alternative ways, and beads are not limited to spherical shapes. For example, a manipulable element may be attached to a garment via a string or other cordage such that the manipulable element may freely rotate around the cordage without disturbing or otherwise causing the garment to move. In embodiments in which fidget elements 20 are embedded in the garment, the person wearing the garment preferably may manipulate fidget elements 20 through the fabric of the garment in order to move fidget elements 20 by flexing the fabric at the location of fidget elements 20 but without causing substantial movement of the garment relative to the person wearing the garment.

In another illustrative embodiment, a hooded sweatshirt 30, (FIG. 2) includes pair of sleeves 32, a hood 34, a waist hemline 36, and a middle torso region 38. Hooded sweatshirt 30 has an overall base configuration that is of conventional garment shape and having a conventional garment size for the wearer. Hooded sweatshirt 30 further includes a front pocket 40 on the front facing region of middle torso region 38. Like t-shirt 10 of FIG. 1, fidget elements 20 may be discreetly incorporated into waist hemline 36 of hooded sweatshirt 30. Waist hemline 36 is sized to define an elongated channel or sleeve 21 in which fidget elements 20 are located, with sufficient clearance between fidget elements 20 and waist hemline that fidget elements 20 may be manipulated by hand along channel 21 formed by waist hemline 36. Similar to t-shirt 10 of FIG. 1, the above-described locations, including hood 34, waist hemline 36, middle torso region 38, and front pocket 40, are adapted to incorporate fidget elements 20 at interior hemlines that are visually imperceptible to an outside observer of hooded sweatshirt 30.

Figure 2:
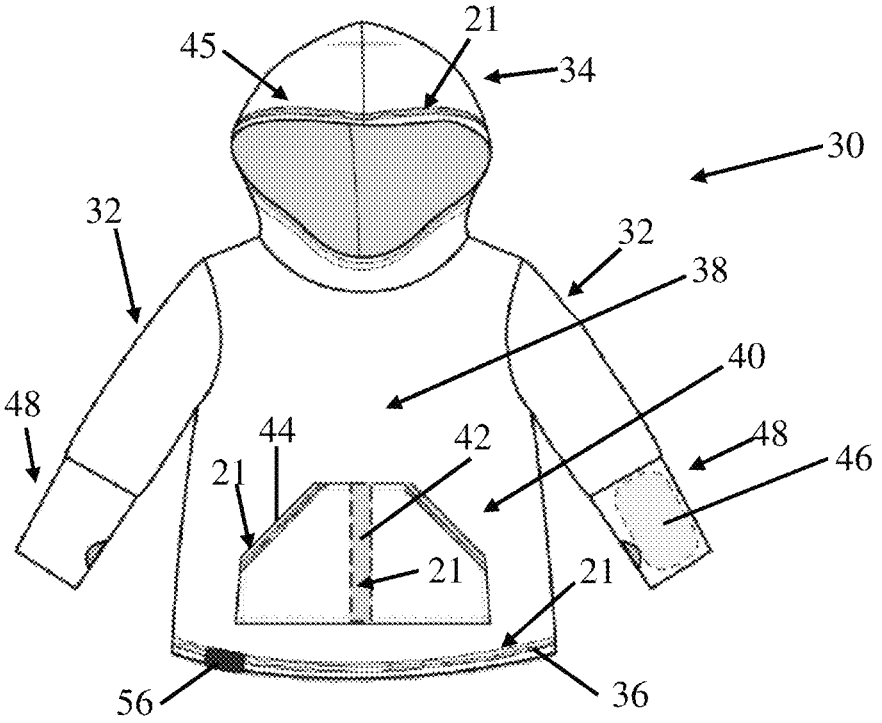
FIG. 2 is a frontal perspective view of another embodiment of the invention embodied as a hooded sweatshirt with embedded fidget elements.
Figure 3:
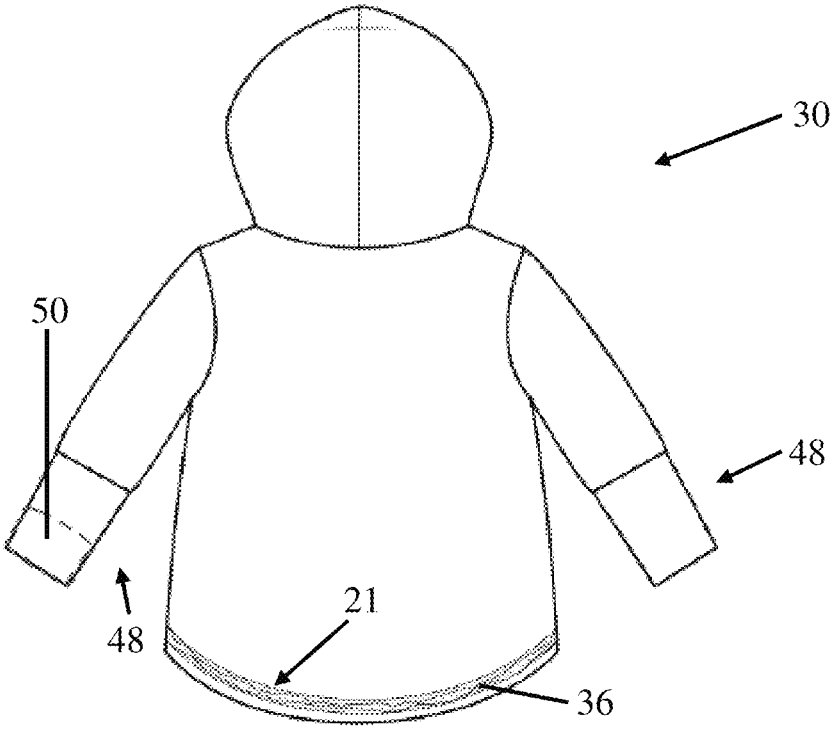
FIG. 3 is a rear perspective view of the hooded sweatshirt of FIG. 2.

Hooded sweatshirt 30 also provides additional or alternative interior hemlines for incorporation of fidget elements 20. (FIGS. 2, 3). Among these locations are an internal elongated channel or sleeve 42 formed on or inside of front pocket 40. As shown in FIG. 2, internal elongated channel 42 may extend vertically along pocket 40. Alternatively, internal elongated channel 42 may extend horizontally or extend in a convoluted path. In another alternative, fidget elements 20 may be included in a hem formed on one or both of the hand entries 44 into front packet 40. In another alternative, a hood hemline 45 around the full or partial circumference of the face opening for hood 34 may provide an elongated channel in which fidget elements 20 are enclosed.

Figure 4:
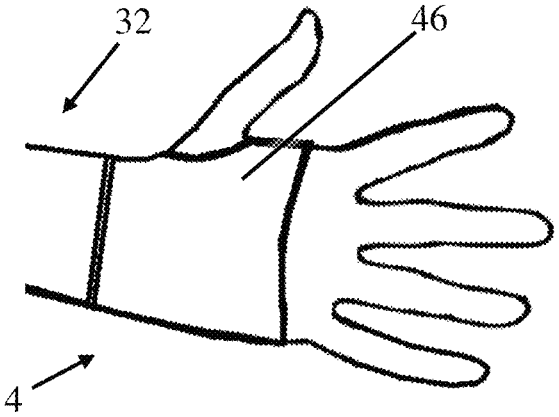
FIG. 4 is a perspective view of a thumbhole sleeve of the sweatshirt of FIG. 2.

As a further alternative, a palm pouch 46 may be formed in one or both of a set of extended cuffs 48 formed on the extended ends of sleeves 32. As shown, extended cuffs 48 are formed with thumb apertures in order to provide wearing sleeves 32 with the ability to be extended over the palm of the wearer's hands. (FIGS. 2 and 4). Alternatively, a hand backside pouch 50 may be included on the backside of one or both extended cuffs 48. (FIG. 3). Palm pouch 46 and hand backside pouch 50 are sized to allow the manual movement of a set of fidget elements 20 within the respective pouches.

Incorporation of fidget elements 20 into palm pouch 46 leaves fidget elements 20 visually imperceptible to an observer standing behind a wearer of hooded sweatshirt 30 (FIG. 3). Fidget elements 20 incorporated into the internal pocket region 42 or the hand backside pouch 46 will be visually imperceptible to an observer from both the front and back sides of the wearer. Both the internal pocket region 42 and the palm pouch 46 are easily accessible by the wearer's hands in such a way that the wearer can discreetly access and manipulate fidget elements 20 without causing a distraction to others nearby. Fidget elements 20 can be incorporated into any combination of the above locations. The placement of fidget elements 20 at certain locations on a garment such as hooded sweatshirt 30 may be more noticeable to persons around the wearer when manipulating fidget elements 20, such as around hood 34. Selection of a desired location for fidget elements 20 may therefore take into account the places and circumstances in which the garment will be worn and as to whether increased concealment of fidget elements 20 is desirable.

While FIGS. 2 and 3 depict fidget elements as only incorporated into the right-hand side of a wearer's palm pouch 46 and hand backside pouch 50, it should be understood that fidget elements 20 can be selectively incorporated into only the wearer's left-hand side palm and hand backside regions, or both the left-hand and right-hand side palm and hand backside regions. Depending on which side is the wearer's dominant hand, it may be beneficial to only incorporate fidget elements into a wearer's non-dominate hand side of hooded sweatshirt 30 so as to not interfere with tasks such as writing.

Figure 5:
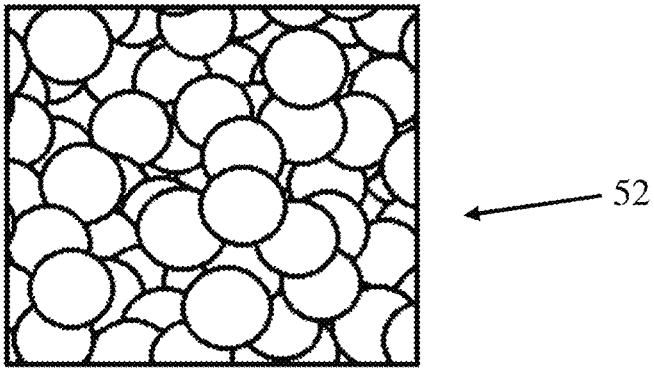
FIG. 5 is a perspective view of one embodiment of pea-sized bead fidget elements used in embodiments of the invention.
Figure 6:
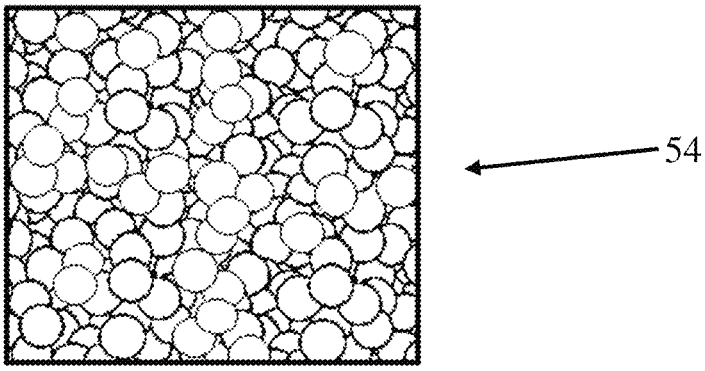
FIG. 6 is a perspective view of alternative rice-sized bead fidget elements used in embodiments of the invention.

The properties of fidget elements 20 themselves are also able to be selected to provide the wearer with customized sensory feedback that is optimized to the wearer's individual needs and desires. One mode of customization is the size of fidget elements 20. For example, the sensory feedback provided by pea-sized bead manipulable elements 52 (FIG. 5) may be preferred by one wearer, while another wearer may prefer the sensory feedback provided by rice-sized bead manipulable elements 54 (FIG. 6). Fidget elements 20 in the form of manipulable elements can also embody forms different than that of spherical beads or pellets. For example, fidget elements 20 may be oval, cylindrical or alternatively have flat surfaces such as a cube or polyhedron. The material forming fidget elements 20 is sufficiently rigid to allow manipulation through the fabric making up the channel 21 or pouch 46, but may alternatively be sufficiently resilient or elastomeric that contact between adjacent fidget elements 20 does not produce a distracting noise.

Figure 8:
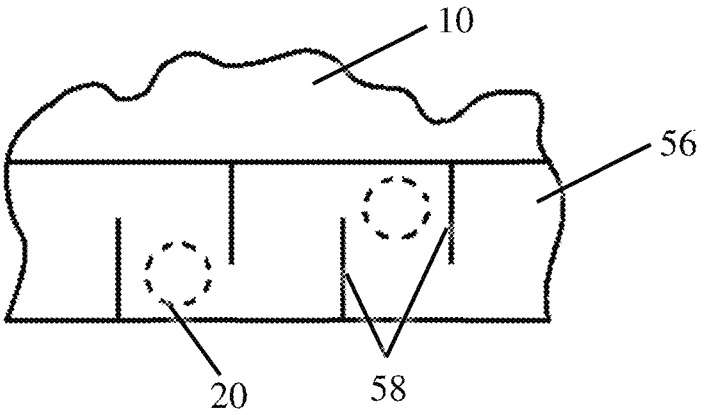
FIG. 8 is a sectional view of a fidget containing enclosure forming an embodiment of the invention

In garments including fidget elements 20 that are manually moved along an elongated channel or sleeve 21, the elongated channel 21 may be generally linear as shown in FIGS. 1 and 2. Alternatively elongated channel 21 may be formed as a convoluted path that requires more complex movement of fidget elements 20 along the channel. In a garment having an exemplary convoluted path 56 formed as a hem or patch along garment 10, obstacles in the form of darts 58 form partial barriers spaced along path 56. FIG. 8. The resulting non-linear, zig-zag, or sinusoidal path 56 thus requires manipulation of fidgets vertically as well as laterally in order to traverse path 56. In alternative embodiments channel 21 is sized sufficiently to allow fidget element 20 to freely move along the channel, but alternatively channel 21 is sized to tightly encompass fidget element 21 to still provide for movement along channel 21 but with much greater resistance to movement and requiring much greater effort to achieve movement of fidget 20. As a still further alternative fidget element 21 is secured on or in the garment so as to not be moveable relative to the garment. In such a non-movable fidget alternative, the wearer manipulates the garment at fidget element 21 without movement of fidget element 21 relative to the garment.

Figure 7:
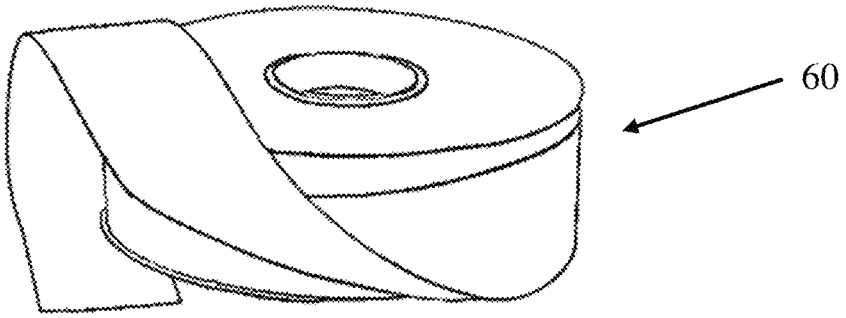
FIG. 7 is a perspective view of textured material used in forming a fidget containing enclosure on the garment of FIG. 2.

In yet another alternative, the fidget element may be a tactile element, or a uniquely textured article that has a different texture than that of the garment. The tactile element, such as textured cloth 60 (FIG. 2), may be a smooth-textured article such as a piece of silk, or a semi-rigid article having one or more raised surfaces such as bumps and/or ridges. In the illustrated embodiment, textured cloth 60 is applied to the garment, and may optionally include manipulable elements such as pellets or other movable items contained within textured cloth 60. For example, a wearer may find the tactile feedback provided by a smooth piece of satin 60 (FIG. 7) to be desirable in addition to or instead of pellets or beads, or alternatively a fabric or other article with a ribbed, napped or rough texture. The uniquely textured cloth fidget element 60 may be incorporated into the wearable article in a fashion similar to that of the movable pellet fidget elements (FIG. 2). Alternatively, a tactile element may be formed as a loop or loops that extend from the surface of the garment. Other modes of customization such as shape, rigidity, color, or audible feedback properties, may be selected as well. In embodiments in which fabric overlays or surrounds fidget elements 20, the fabric is to be sufficiently flexible and have a thickness to allow manipulation of manipulable elements such as fidget elements 20 through the fabric.

In other embodiments, fidget elements 20 may be incorporated into various types of pants, shorts, skirts or other wearable articles (not shown) designed to cover at least a portion of a wearer's legs. In pant-form of embodiments, fidget elements 20 may similarly be incorporated into waistlines, hemlines, pockets, or other locations on the wearable article.

In another embodiment, fidget elements 20 may be incorporated into a glove (not shown). Similar to the incorporation of fidget elements into palm region 46 and hand backside region 50 of hooded sweatshirt 30 (FIGS. 2 and 3), fidget elements 20 may likewise be located in the palm region and hand backside region of a glove. In addition, fidget elements 20 maybe incorporated into the portion of the glove that covers the wearer's fingers.

Fidget elements 20 incorporated into the wearable article may also be coupled together to form an assembly of fidget elements. The wearer may also selectively couple and create uniquely satisfying combinations and arrangements of fidget elements 20 which are incorporated into the wearable article. Additionally, the coupling mechanism between fidget elements 20 may vary such that the act of coupling fidget elements 20 itself produces its own unique sensory feedback to the wearer. For example, fidget elements 20 may be slidably or rotatably coupled to a garment such that the fidget element 20 may be moved or otherwise manipulated freely in a unique motion or pattern relative to the garment.

Figure 9:
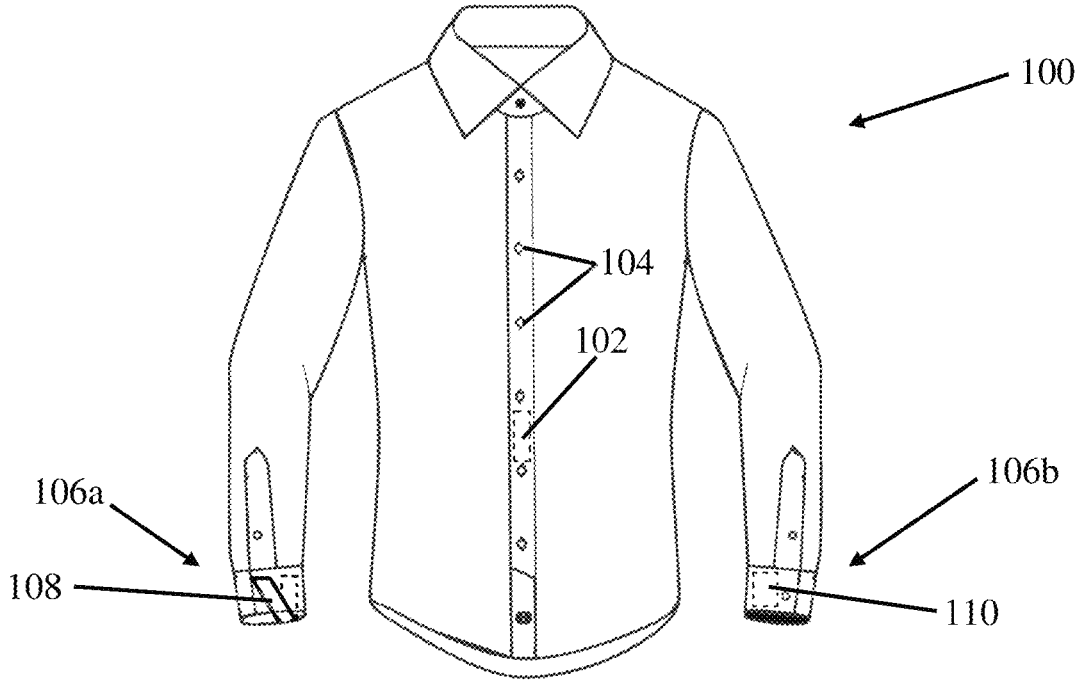
FIG. 9 is a frontal perspective view of another embodiment of the invention embodied as a button-up shirt.

Referring now to the illustrated embodiment of FIG. 9, a button-up shirt 100 includes multiple locations which may contain or otherwise incorporate fidget elements 20. For example, a center torso area or pocket 102 is located between adjacent center buttons 104 on the interior side of button-up shirt 100. Additionally, each sleeve cuff 106 of shirt 100 has a cuff pocket or area which may contain or otherwise incorporate fidget elements 20. In the illustrated embodiment, a textured item 108, which could be made of smooth satin 60 of FIG. 7 or other uniquely textured material, is sewn into a right sleeve cuff 106*a* such that it is accessible to a wearer of button-up shirt 100 via the exterior or interior of sleeve cuff 106*a*. That is, portions of textured item 108 are located on both internal and external surfaces of button-up shirt 100. A left sleeve cuff 106*b* includes a sewn-in pocket 110 that may be textured and/or hold or incorporate fidget elements 20. In the illustrated embodiment, pocket 110 is located on the interior of left sleeve cuff 106*b* such that it is not visually perceptible by an outside observer of button-up shirt 100.

Figure 10:
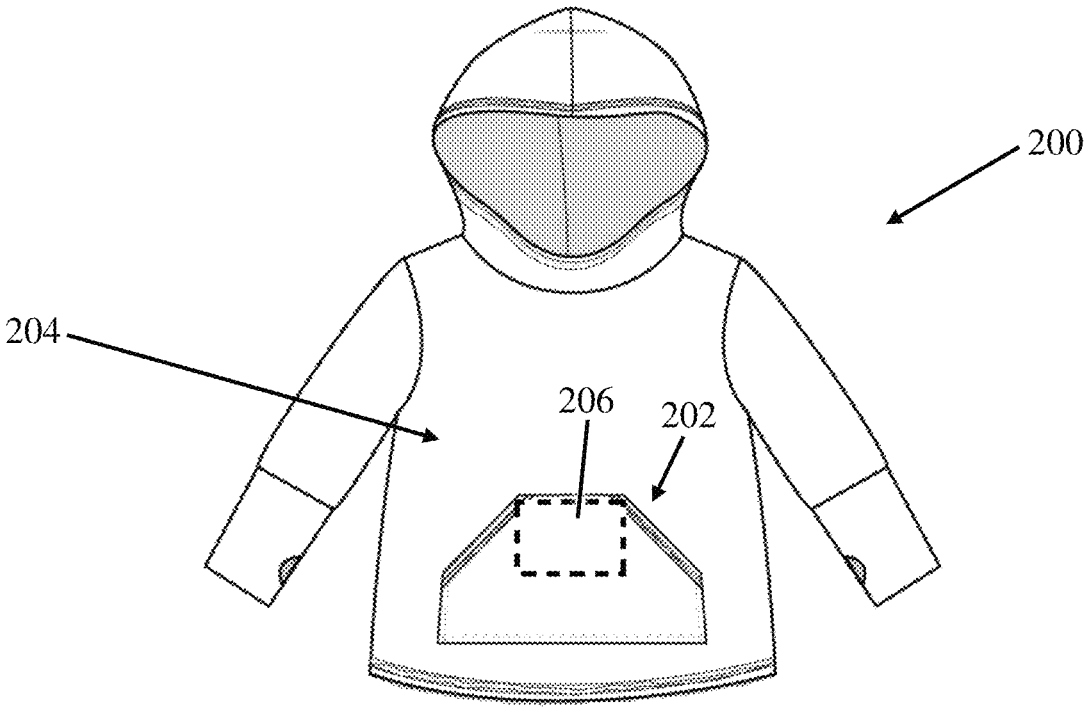
FIG. 10 is a frontal perspective view of yet another embodiment of a hooded sweatshirt that incorporates fidget elements.

Referring now to the illustrated embodiment of FIG. 10, another hooded sweatshirt 200 includes a front pocket 202 on the front facing region of middle torso region 204. Like hooded sweatshirt 30 of FIG. 2, fidget elements 20 may be discreetly incorporated front pocket 202 of hooded sweatshirt 200 via an internal pocket 206. Internal pocket 206 is not visually perceptible to an outside observer of hooded sweatshirt 200, and may be accessed by a wearer of hooded sweatshirt 200 while the wearer's hands are within front pocket 202. Internal pocket 206 may further include textured material such as the smooth satin 60 depicted in FIG. 7.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A therapeutic garment, comprising: an article of clothing shaped to be worn by a person; an enclosure formed on said article of clothing that can be reached by the person while wearing said article of clothing;

a manipulable tactile element contained within said enclosure, said enclosure comprising an elongated channel forming a longitudinal path extending along a longitudinal axis;

a lateral extent extending partially into said elongated channel and orthogonal to said longitudinal axis, said elongated channel being sized to tightly encompass said manipulable tactile element to generate resistance to movement of said manipulable tactile element along said longitudinal path and around said lateral extent, thereby to restraining the movement of said manipulable tactile element in said elongated channel along said longitudinal path until the person applies a greater force to overcome said resistance to move said manipulable tactile element along said longitudinal path and around said lateral extent in said elongated channel;

and said enclosure formed from a fabric to provide the person with the ability to manually manipulate said manipulable tactile element by manipulating said enclosure.

2. The therapeutic garment of claim 1, wherein said article of clothing comprises a cuff, and wherein said enclosure is located at said cuff.

3. The therapeutic garment of claim 1, wherein said article of clothing comprises a hemline, and wherein said enclosure is located at said hemline.

4. The therapeutic garment of claim 1, wherein said manipulable tactile element comprises a bead.

5. The therapeutic garment of claim 1, wherein said article of clothing comprises a waist hemline, and wherein said enclosure is located at said waist hemline.

6. A therapeutic garment, comprising:

an article of clothing shaped to be worn by a person;

an enclosure formed at said article of clothing at a location that can be reached by the person while wearing said article of clothing; and a manipulable tactile element contained within said enclosure, said enclosure formed from a fabric to provide the person with the ability to manually manipulate said manipulable tactile element, said enclosure comprising an elongated channel having a longitudinal length extending along a longitudinal axis and first and second ends, said elongated channel including an obstacle extending partially into the said elongated channel from one side of the channel and orthogonal to said longitudinal axis leaving a gap between an end of the obstacle and another side of the elongated channel to form a non-linear path in said elongated channel between said first and second ends, the gap being sized to allow the manipulable tactile element to pass over the obstacle when moved along said non-linear path wherein the person must move said manipulable tactile element around said obstacle in said non-linear path relative to said longitudinal axis to move the manipulable tactile element between said first end and said second end.

7. The therapeutic garment of claim 6, wherein said manipulable tactile element comprises a bead.

8. The therapeutic garment of claim 1, wherein said elongated channel is located on an interior surface of said article of clothing such that said enclosure is visually imperceptible to an observer of the wearable article.

9. The therapeutic garment of claim 1, wherein said article of clothing comprises a pocket, and wherein said elongated channel is located within said pocket.

10. The therapeutic garment of claim 7, further comprising a plurality of beads contained within said elongated channel.

11. The therapeutic garment of claim 6, wherein said article of clothing further comprises a second elongated channel, a second manipulable tactile element, and a waist hemline, wherein said second elongated channel is located at said waist hemline, wherein said second manipulable tactile element is contained within said second elongated channel and sized to provide the ability for movement of said second manipulable tactile element within said second elongated channel, and wherein said second elongated channel is formed from a fabric to provide the person with the ability to manually manipulate said second manipulable tactile element by manipulating said second elongated channel.

* * * * *